US005881567A

United States Patent [19]

Junge et al.

[11] Patent Number: 5,881,567

[45] Date of Patent: Mar. 16, 1999

[54] REFRIGERATOR CONDENSER AIR FLOW

[75] Inventors: Brent A. Junge; Martin W. Barnett, both of Evansville; Thomas G. Merrill, Newburgh; Dennis G. Schenk, Evansville, all of Ind.

[73] Assignee: Whirlpool Corporation, Benton Harbor, Mich.

[21] Appl. No.: 939,827

[22] Filed: Sep. 29, 1997

[51] Int. Cl.[6] ..... F25D 17/06

[52] U.S. Cl. ..... 62/428; 62/452; 62/508

[58] Field of Search ..... 62/404, 407, 408, 62/410, 419, 426, 427, 440, 441, 452, 453, 454, 455, 456, 506, 507, 508; 165/121, 122, 171

[56] References Cited

U.S. PATENT DOCUMENTS

| | | | |
|---|---|---|---|
| 2,688,794 | 9/1954 | Malutich | 29/157.3 |
| 2,772,077 | 11/1956 | Polad | 257/256 |
| 2,776,551 | 1/1957 | Lichtenberger | 62/126 |
| 2,795,035 | 6/1957 | Kafer | 29/157.3 |
| 3,046,758 | 7/1962 | Heuer et al. | 62/126 |
| 3,111,818 | 11/1963 | Dolan et al. | 62/419 |

FOREIGN PATENT DOCUMENTS

| | | | |
|---|---|---|---|
| 1396436 | 3/1964 | France | 62/428 |

*Primary Examiner*—John M Sollecito
*Attorney, Agent, or Firm*—Robert O. Rice; Stephen D. Krefman; Joel M. Van Winkle

[57] ABSTRACT

A plate and tube condenser for a refrigerating apparatus, the plate sized to encompass the entire bottom region of a refrigerating cabinet to structurally stiffen the cabinet, the plate serving as an extended heat transfer surface for a serpentine tube applied thereto either by fixation thereto. An air flow baffle is arranged to divide the plate into inlet air and outlet air sections both opening to a front of the cabinet behind the air grill. Perforations are applied through the plate on the inlet section to allow incoming air to pass both below and above the plate.

6 Claims, 2 Drawing Sheets

REFRIGERATOR CONDENSER AIR FLOW

BACKGROUND OF THE INVENTION

The present invention relates to refrigerating appliances, and particularly to a condenser arrangement for a domestic refrigerating appliance.

In a conventional, domestic refrigerating appliance, a refrigerant cycle is used to cool air which is circulated throughout an inside volume of the cabinetry of the appliance. The refrigerating cycle includes the typical components of evaporator, pressure reducing valve, condenser, and compressor. The evaporator provides coils having refrigerant therein, which absorbs heat from air blown across the coils, thus cooling the air for circulation through the cabinet. The evaporator is typically located in the freezer compartment of a freezer/refrigerator appliance.

The condenser provides coils for air cooling the refrigerant therein to condense the refrigerant. The compressor and the condenser are typically located in a bottom most compartment of the appliance and the condenser receives air through a front grill which is located beneath the refrigerator door. The compressor is located to be accessible from a rear of the refrigerator. Also located in this bottom most compartment is a fan for drawing air across the condenser. Such a refrigerating appliance is shown for example in U.S. Pat. No. 5,465,591.

Beneath this lowest most compartment, it is customary to provide a solid base plate which aids in reinforcing cabinet stability. Upon this solid base plate is typically installed a coiled condenser composed of a serpentine elongate tube upon which is welded a plurality of closely spaced wires which provide an extended heat transfer surface. These tube and wire condensers have some drawbacks. The current painting process for coating these condensers is a solvent rich process. The process uses around 80% solvent which is regulated by the EPA for VOC's (Volatile Organic Compounds). This process is required to adequately coat the wires. It would be an advantage to eliminate this process to reduce the amount of solvents needed for the coating process. Additionally, the welding process for connecting the wires to the tube is maintenance and capital intensive.

U.S. Pat. No. 3,111,818 describes a refrigerating apparatus with a condenser assembly made from two flat plates having mating half-tube sections embossed in them. The two plates are welded together with the half-tube sections in juxtaposition to form a single sealed continuous fluid conduit through which the refrigerant passes. The condenser assembly, however, does not include a base plate which adds stability to the refrigerator cabinetry. U.S. Pat. No. 2,772,077 also describes a plate/tube condenser for a refrigerating apparatus, wherein tubes are formed separately and connected to a plate as extended heat surface.

SUMMARY OF THE INVENTION

It is an object of the present invention to provide a condenser for a refrigerating apparatus which in addition to providing a heat transfer surface, functions as a base plate for the appliance cabinetry. It is an object of the present invention to provide a condenser which is effective and efficient in heat transfer therethrough. It is an object of the invention to provide a heat exchange arrangement for a refrigerating appliance which is compact. It is an object of the present invention to provide a heat exchange arrangement for a refrigerating appliance which can receive air from a front side of the appliance and discharge air also through a front side of the appliance.

It is an object of the invention to provide a refrigerator condenser arrangement for mounting in a lowest most compartment of refrigerator cabinetry and which includes the condenser, the compressor, and an air fan wherein air is drawn through one side of the front grill and discharged through an adjacent side of the front grill. It is an object of the invention to provide a refrigerator condenser of a plate and tube heat exchanger type. It is an object of the invention to provide a refrigerator condenser which is more effectively and efficiently manufactured, and which is more environmentally friendly during the manufacture thereof. It is an object of the invention to provide a refrigerator condenser coil which has an increased compactness such that the volume inside the refrigerating cabinet can be increased.

The objects of the invention are achieved in a refrigerator condenser which is mounted in a lowest most compartment of a refrigerating appliance. The refrigerator condenser is arranged with a fan to draw air through a front grill of the appliance and discharge the warmed air through the same front grill of the appliance. The refrigerator condenser includes a baffle plate arranged vertically on top of the condenser coil to separate the incoming and outgoing air passing over the condenser on an intake side of the condenser, the plate and tube condenser includes perforations to allow air to pass over a top of and below the condenser coil to the fan. The outlet side of the coil includes no such apertures so that air on an outlet side passes only on top of the condenser to prevent short circuiting air flow from an outlet side to an inlet side of the fan. The condenser is arranged flat and equivalent in area to substantially the bottom area of the appliance such as to act as a structural base plate for the appliance. The condenser includes space on its plate for mounting the fan and the compressor. The condenser includes the plate and a connected serpentine tube which can be fixed by brazing, welding, soldering, use of an adhesive or mechanical fastening or can be an embossment between two opposing plates.

DETAILED DESCRIPTION OF THE PREFERRED EMBODIMENTS

Figure 1:
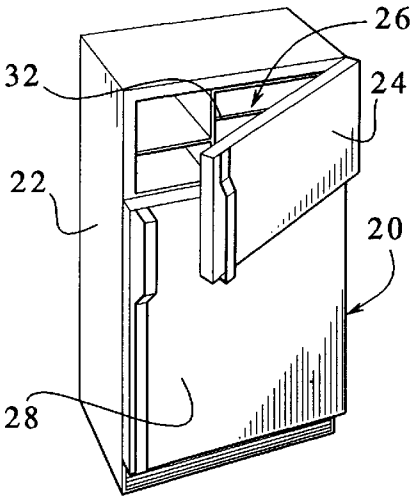
FIG. 1 is a perspective view of a refrigerating appliance incorporating the present invention.
Figure 2:
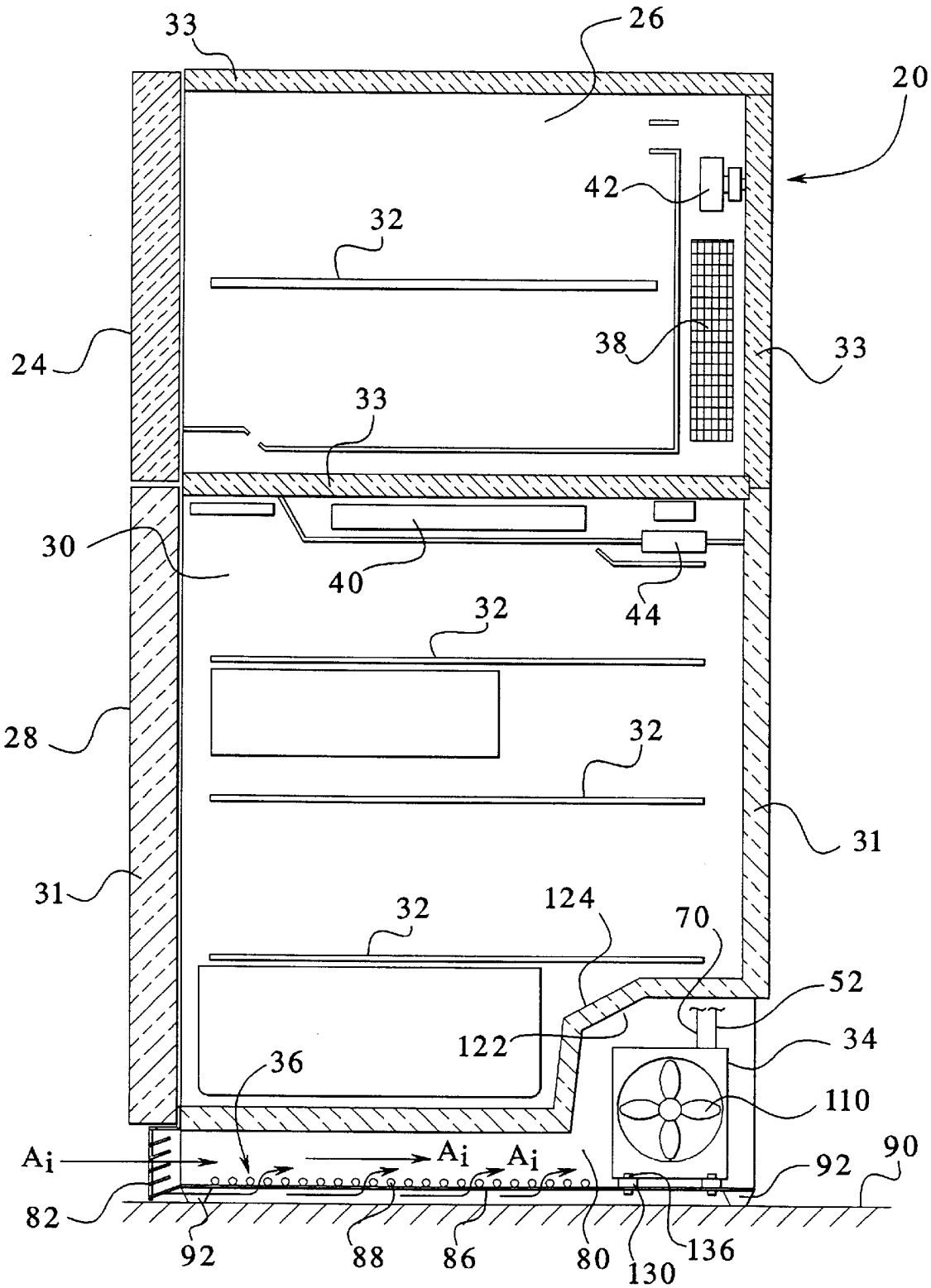
FIG. 2 is a sectional view of a refrigerating appliance shown in FIG. 1.

In FIGS. 1 and 2, there is shown generally a refrigeration appliance 20 having an exterior cabinet 22 with a first openable door 24 to allow access to a first compartment 26. A second openable door 28 allows access into a second interior compartment 30. Within each of the compartments 26, 30 are storage areas for receiving food articles, including shelves, trays, bins, etc. Typically, the compartment 26 is a freezer compartment and the compartment 30 is a refrigerated compartment which maintains products in a chilled but not frozen condition.

The refrigeration system for the two compartments includes a compressor 34, a condenser 36, and an evaporator 38. Fan 42 is provided for circulating air.

Figure 3:
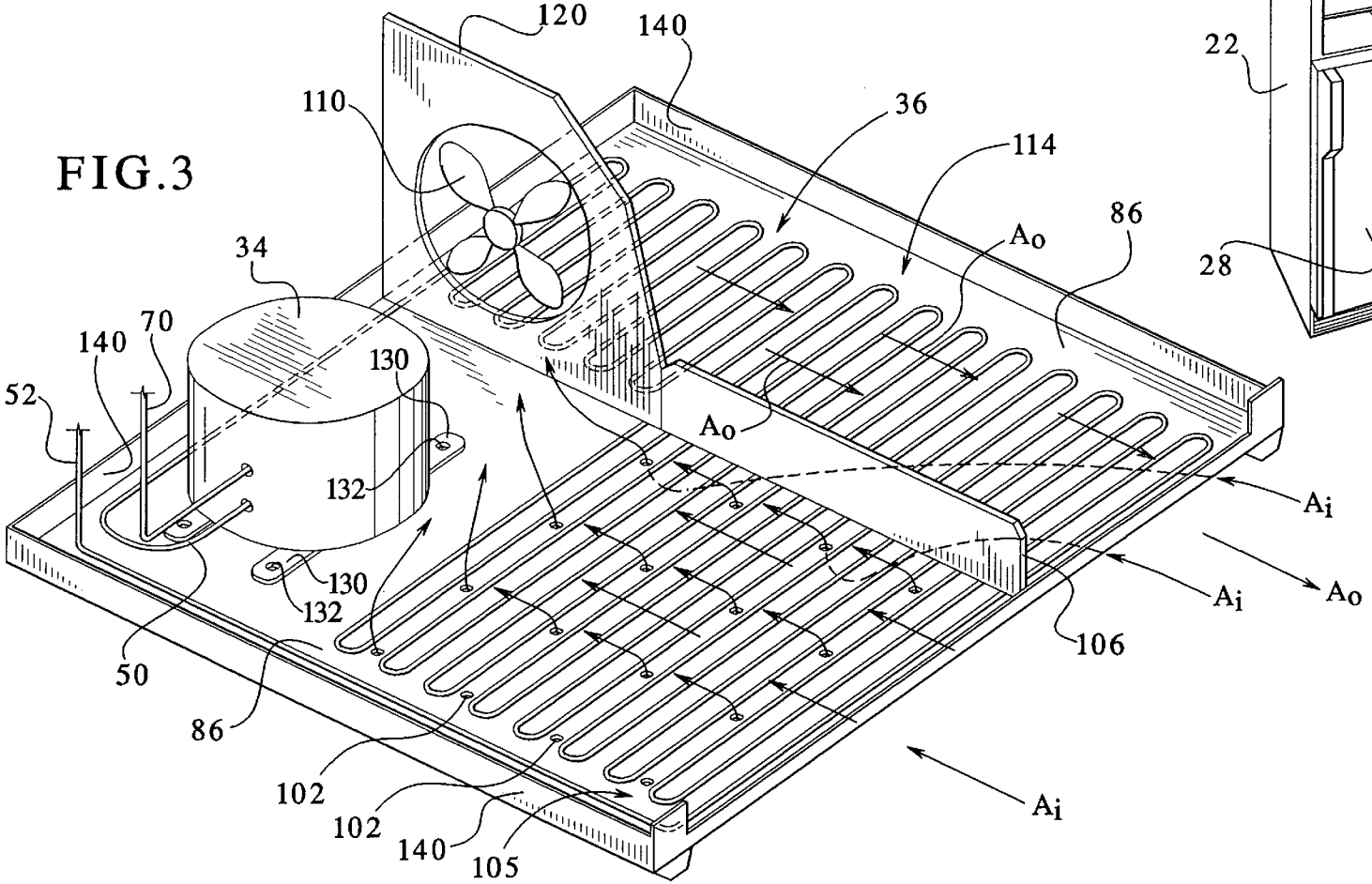
FIG. 3 is a schematic perspective view of the condenser shown in FIG. 2.

The compressor 34 supplies refrigerant through line 50 (see FIG. 3) to the condenser 36. Refrigerant flows from the condenser through line 52 to the heat loop. The refrigerant then moves through the capillary tube (not shown) to the evaporator 38, and after leaving the evaporator, refrigerant is returned by a suction line 70 to the compressor 34. A more detailed explanation of a refrigerating circuit can be found in U.S. Pat. No. 5,465,591, herein incorporated by reference.

The condenser 36 is located in a bottom compartment 80 of the refrigerated appliance 20. This compartment is covered at a front side by a grill 82 for allowing air to enter the compartment 80. The condenser includes a plate 86 which substantially covers a bottom profile of the refrigerator appliance 20 to torsionally stabilize the structural frame of the cabinetry. Attached to a surface of the plate 86 is a serpentine coiled tube 88 which acts as the condenser holding refrigerant therein. The plate 86 thus provides the extended heat transfer surface to the tube 88, i.e., a plate fin. The plate 86 is somewhat elevated from a floor surface 90 by feet portions 92. The feet portions 92 can also provide adjustable leveling feet (not shown). The plate 86 provides apertures 102 spaced apart on an inlet section 105 of an air baffle wall 106. The apertures 102 allow incoming air $A_i$ to pass above and beneath the plate 86, the air passing through the grill 82 above and beneath the plate 86 rising through the apertures 102 under influence of a fan 110. The baffle wall 106 separates outgoing air $A_o$ from incoming air $A_i$. An outlet section 114 has no perforations and the outlet air $A_o$ passes only on top of the plate 86 in the outlet section 114. This prevents short circuiting of warm air to the inlet section 105. However, inlet air $A_i$ can pass beneath the outlet section 114 and join the incoming air $A_i$ eventually passing up through the apertures 102 to the fan 110. However, most of the incoming air proceeds from the inlet section 105.

The plate 86 is advantageously made of galvanized steel and the tube 88 is surface protected such as by galvanizing or powder coat painting. A savings in labor and materials over the known tube and wire exchanger is realized, including eliminating a complicated, solvent rich coating step in treating the wires of the known exchanger.

The fan 110 is circumscribed by a baffle plate 120 which is shaped to conform to an inside clearance 122 of an insulated floor portion 124 of the compartment 30. This prevents short circuiting of air from the outlet section 114 to the inlet section 105. The fan 110 is shown schematically for clarity, but is understood that an appropriate electric motor drives the fan for air flow. The compressor 34 is provided with support brackets 130 having apertures 132 for receiving fasteners 136 (such as machine screws) as shown in FIG. 2, which can connect directly to the plate 86 by a tapped opening, or by a nut on a bottom side of the plate 86. Thus, the plate 86 serves as the condenser extended heat transfer surface and also as a support base for the components such as a compressor 34 and the fan 110 (not shown). By being a continuous plate, the plate 86 also stiffens the structural integrity of the cabinetry, preventing the rectangular cross section of the cabinet from torsional twisting and deformation. The plate 86 provides a surrounding rim or sidewall 140 for connection to the cabinetry 22. The rectangular plate 86 thus stiffens the rectangular cross section for the cabinetry walls 22.

As stated above, the plate and tube condenser 36 can be constructed using a continuous plate piece with a serpentine tube fastened thereto such as shown for example in U.S. Pat. No. 2,772,077 or U.S. Pat. No. 2,688,794, or U.S. Pat. No. 2,795,035. Or the tube can be formed with a plate such as shown in U.S. Pat. No. 3,046,758, or the plate can be formed by two opposing plates with half tubes embossed on each plate, such that by fixing the plates together tube channels are formed by the plates themselves.

Although the present invention has been described with reference to a specific embodiment, those of skill in the art will recognize that changes may be made thereto without departing from the scope and spirit of the invention as set forth in the appended claims.

The embodiments of the invention in which an exclusive property or privilege is claimed are defined as follows:

1. A heat exchanger for a refrigerated compartment comprising:

a plate;

a serpentine tube mounted on said plate; and a baffle means for directing air in a general U-shaped direction across said plate; and perforations on one side of said U-shaped path allowing air to move from below said plate to above said plate through said perforations.

2. The heat exchanger according to claim 1, wherein said plate is sized to substantially encompass a bottom area of said compartment.

3. The heat exchange according to claim 1, wherein said serpentine tube is a separate coiled tube fixed to said plate, said plate being a solid plate.

4. A refrigerated compartment comprising:

a generally rectangular block shaped insulated compartment for storing goods to be refrigerated;

an evaporator located in thermal communication with an inside of said compartment;

a bottom compartment located beneath said refrigerated compartment, said bottom compartment including therein a compressor and a condenser, said condenser comprising a serpentine tube mounted on a plate, said plate substantially extending across a bottom of said bottom compartment, said compressor mounted to said plate;

a front opening to said bottom compartment, support means for elevating said plate above a support surface, said opening allowing air to pass both above and below said plate, a refrigeration circuit means for circulating refrigerant from said evaporators to said compressor to said condenser and back to said evaporator; and a baffle means arranged on top of said plate and perpendicular to both said plate and said opening, dividing said air flow across said plate into a U-shape, wherein said plate is perforated on one side of said baffle means.

5. A refrigerated compartment comprising:

a generally rectangular block shaped insulated compartment for storing goods to be refrigerated;

an evaporator located in thermal communication with an inside of said compartment;

a bottom compartment located beneath said refrigerated compartment, said bottom compartment including therein a compressor and a condenser, said condenser comprising a serpentine tube mounted on a plate, said plate substantially extending over a bottom of said bottom compartment, said plate having a surrounding sidewall connected to said refrigerated compartment to stiffen said block shaped insulated compartment, said compressor mounted to said plate, a front opening into said bottom compartment, support means for elevating said plate above a support surface, said opening allowing air to pass both above and below said plate, a refrigeration circuit means for circulating refrigerant from said evaporators to said compressor to said condenser and back to said evaporator;

a fan for moving air over said plate; and a baffle means arranged on top of said plate and perpendicular to both said plate and said opening, dividing said air flow induced by said fan across said plate into a U-shape, wherein said plate is perforated on one side of said baffle means.

6. The refrigerated compartment of claim 5, wherein said serpentine tube is a separate coiled tube fixed to said plate, said plate being a solid plate.

* * * * *